US011767151B2

(12) United States Patent
Lai

(10) Patent No.: US 11,767,151 B2
(45) Date of Patent: Sep. 26, 2023

(54) INNER BUCKLING TYPE TOOL BOX

(71) Applicant: KING TONY TOOLS CO., LTD., Taichung (TW)

(72) Inventor: Ching-Hua Lai, Taichung (TW)

(73) Assignee: KING TONY TOOLS CO., LTD., Taichung (TW)

( * ) Notice: Subject to any disclaimer, the term of this patent is extended or adjusted under 35 U.S.C. 154(b) by 0 days.

(21) Appl. No.: 18/064,672

(22) Filed: Dec. 12, 2022

(65) Prior Publication Data

US 2023/0202726 A1 Jun. 29, 2023

(30) Foreign Application Priority Data

Dec. 28, 2021 (TW) ..... 110149145

(51) Int. Cl.
*B65D 55/02* (2006.01)
*B25H 3/02* (2006.01)

(52) U.S. Cl.
CPC ..... *B65D 55/02* (2013.01); *B25H 3/02* (2013.01); *Y10S 292/37* (2013.01); *Y10S 292/63* (2013.01)

(58) Field of Classification Search
CPC ..... B65D 55/02; B25H 3/02; E05B 65/006; E05B 65/0067; E05B 65/5215; E05B 65/523; E05B 65/5238; Y10T 292/0977; Y10S 292/37; Y10S 292/38; Y10S 292/63
USPC ..... 206/349, 372–379; 24/100.5
See application file for complete search history.

(56) References Cited

U.S. PATENT DOCUMENTS 4,962,800 A * 10/1990 Owiriwo ..... A45C 3/06 D3/323
7,931,143 B1 * 4/2011 Lin ..... B25H 3/021 220/629
10,582,287 B2 * 3/2020 Song ..... H01F 7/02
2006/0207903 A1 * 9/2006 Chen ..... B25H 3/003 206/45.24

* cited by examiner

*Primary Examiner* — Rafael A Ortiz
*Assistant Examiner* — Sanjidul Islam
(74) *Attorney, Agent, or Firm* — Sinorica International Patent & Trademark

(57) ABSTRACT

An inner buckling type tool box includes a first housing, a second housing, a locking member, a pushing member, and an elastic member. An inner wall of the first housing is provided with an accommodating portion to accommodate a locking member and a pushing member located between the inner wall and the locking member. The pushing member enables to slide vertically relative to the inner wall to drive the locking member to slide in a direction parallel to the inner wall, so that the locking member is selectively to be engaged with or disengaged form the second housing. Through a change in the moving direction, the occupation of deep space can be reduced greatly to maintain the capacity of the tool box.

10 Claims, 8 Drawing Sheets

INNER BUCKLING TYPE TOOL BOX

FIELD OF THE INVENTION

The present invention relates to a tool box, and more particularly to a tool box with a locking mechanism.

BACKGROUND OF THE INVENTION

In general, a conventional tool box has a locking mechanism between the upper and lower covers for locking the upper and lower covers. The locking mechanism may be arranged in two different manners. One is to arrange the locking mechanism at the outside of the tool box. The advantage is that the locking mechanism will not occupy the internal space of the conventional tool box. However, the locking mechanism is relatively easy to be impacted and damaged, or the tool box may be opened by mistake. The other is to arrange the locking mechanism at the inside of the tool box. However, such a design needs more deep space for the movement of the locking mechanism, which reduces the capacity of the internal space greatly and is not conducive to the miniaturization of the tool box. Besides, the built-in locking mechanism possesses only one locking mechanism subject to the way of movement. When the conventional tool box carries heavy tools, the locking mechanism is prone to unintended detachment when impacted.

SUMMARY OF THE INVENTION

The primary object of the present invention is to provide an inner buckling type tool box. Through a change in the moving direction, a locking member enables to slide in the inner buckling type tool box in a direction parallel to a wall of a housing, so that the occupation of deep space can be reduced greatly to maintain the capacity of the inner buckling type tool box.

In order to achieve the above object, the present invention provides an inner buckling type tool box. The inner buckling type tool box comprises a first housing, a second housing, a locking member, a pushing member, and an elastic member. The first housing has a first free wall. An inner surface of the first free wall is provided with an accommodating portion. The second housing is turnable to cover the first housing. The second housing has a second free wall corresponding to the first free wall. The second free wall is provided with a first locking portion corresponding to the accommodating portion. The locking member is disposed at the accommodating portion. The locking member is movable relative to the first housing along a transverse axis to be in a closed position or in an open position. The transverse axis is parallel to the first free wall. The locking member has a second locking portion corresponding to the first locking portion. When the locking member is in the closed position, the second locking portion is engaged with the first locking portion. When the locking member is in the open position, the second locking portion is disengaged from the first locking portion. The pushing member is disposed at the accommodating portion and located between the first free wall and the locking member. The pushing member is movable relative to the first housing along a longitudinal axis to be in an initial position or in a pressed position. The longitudinal axis is perpendicular to the first free wall. When the pushing member is pushed by an external force to move from the initial position to the pressed position, the pushing member drives the locking member to move from the closed position to the open position. The elastic member is disposed at the accommodating portion. The elastic member is configured to apply an elastic force to drive the locking member and make the locking member having a movement tendency to move from the open position to the closed position therefore making the pushing member driven by the locking member to have a movement tendency from the pressed position to the initial position.

When the user presses the pushing member along the longitudinal axis, the pushing member is moved from the initial position to the pressed position, and the locking member is driven to slide along the transverse axis and move from the closed position to the open position. The second locking portion is disengaged from the first locking portion, so that the second housing can be turned relative to the first housing to open the inner buckling type tool box. Thus, the locking member enables to slide in the tool box in a direction parallel to the wall of the housing, so that the occupation of deep space can be reduced greatly, so as to maintain the capacity of the inner buckling type tool box.

DETAILED DESCRIPTION OF THE PREFERRED EMBODIMENTS

Embodiments of the present invention will now be described, by way of example only, with reference to the accompanying drawings.

Figure 1:
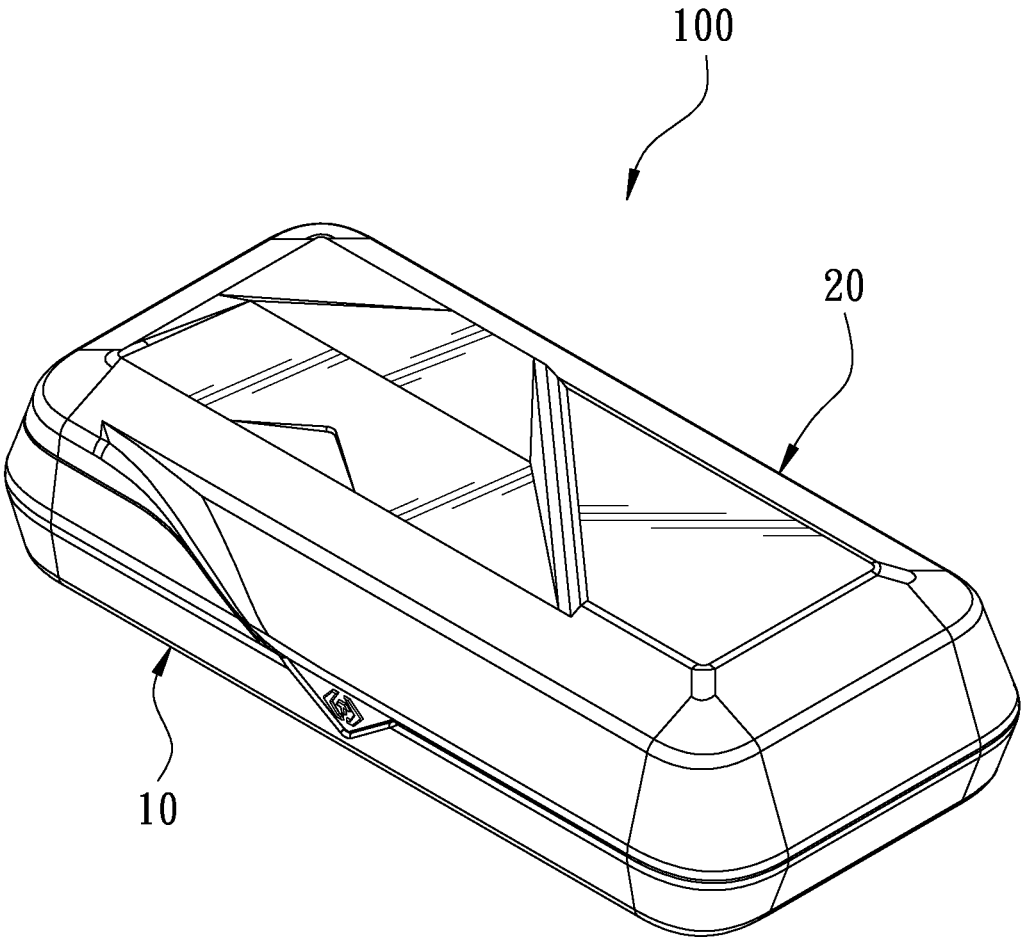
FIG. 1 is a perspective view of a preferred embodiment of the present invention in a closed state.
Figure 2:
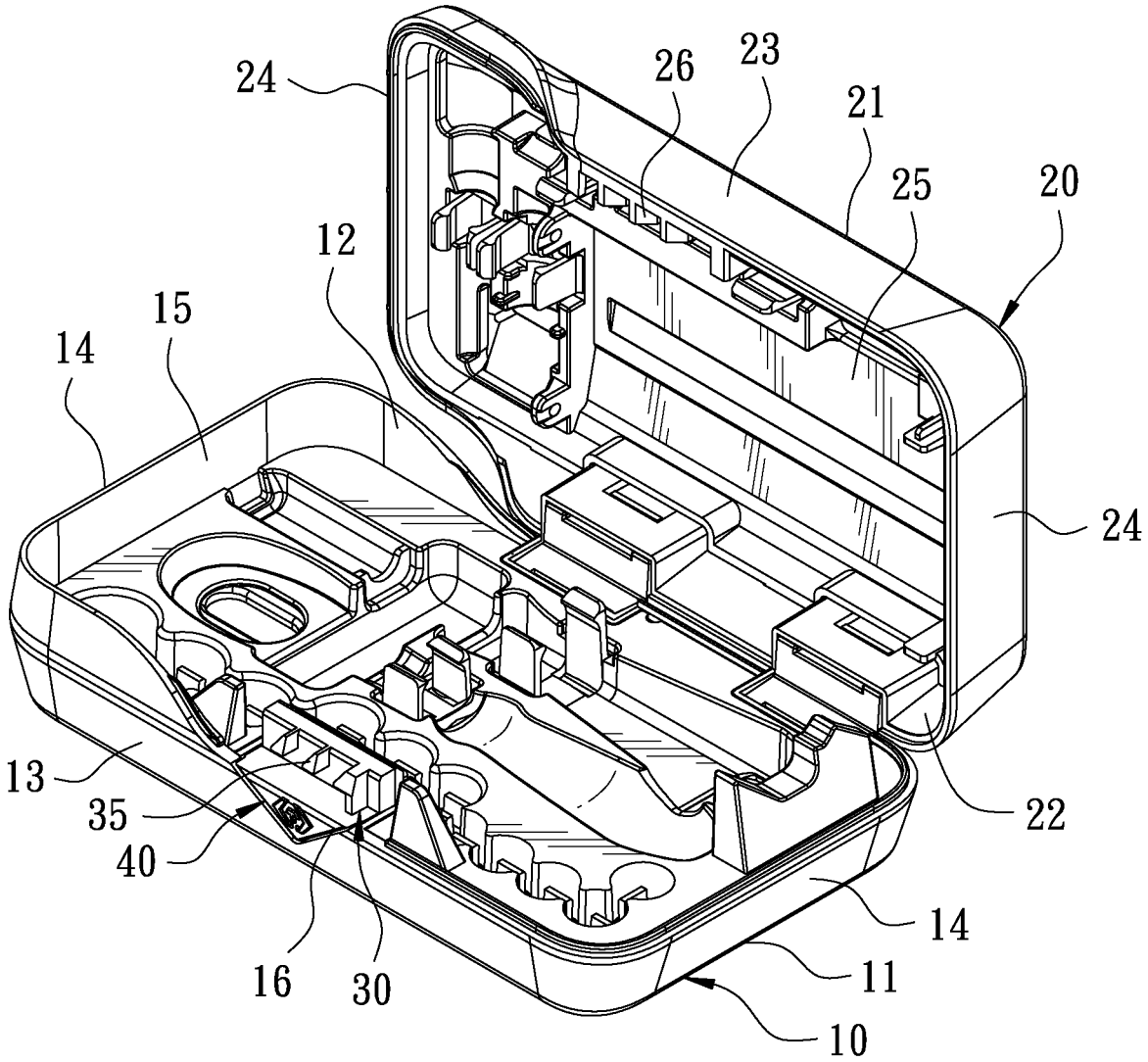
FIG. 2 is a perspective view of the preferred embodiment of the present invention in an open state.

FIG. 1 is a perspective view of a preferred embodiment of the present invention in a closed state. FIG. 2 is a perspective view of the preferred embodiment of the present invention in an open state. The present invention discloses an inner buckling type tool box 100. The inner buckling type tool box 100 comprises a first housing 10 and a second housing configured to cover the first housing 10. The first housing 10 has a first bottom wall 11. A first connecting wall 12 and a first free wall 13 are provided at the peripheral side of the first bottom wall 11. The first free wall 13 may be disposed at any position. For example, the first free wall 13 is connected to one side of the first connecting wall 12. Preferably, as shown in this embodiment, under the condition that the first bottom wall 11 is a rectangle, the first free wall 13 is disposed at the opposite side of the first connecting wall 12. Two first side walls 14 are provided between the first connecting wall 12 and the first free wall 13. A first space 15 is defined among the first connecting wall 12, the first free wall 13 and the first side walls 14 for storing tools. The second housing 20 has a second bottom wall 21 corresponding to the first bottom wall 11. The peripheral side of the second bottom wall 21 is provided with a second connecting wall 22 corresponding to the first connecting wall 12. The second connecting wall 22 is rotatably connected to the first connecting wall 12, so that the second housing 20 is turnable relative to the first housing 10 to be in a closed state as shown in FIG. 1 or in an open state as shown in FIG. 2. The second housing 20 further has a second free wall 23 corresponding to the first free wall 13. Two second side walls 24 are provided between the second connecting wall 22 and the second free wall 23. A second space 25 is defined among the second connecting wall 22, the second free wall 23 and the second side walls 24 for storing tools.

Figure 3:
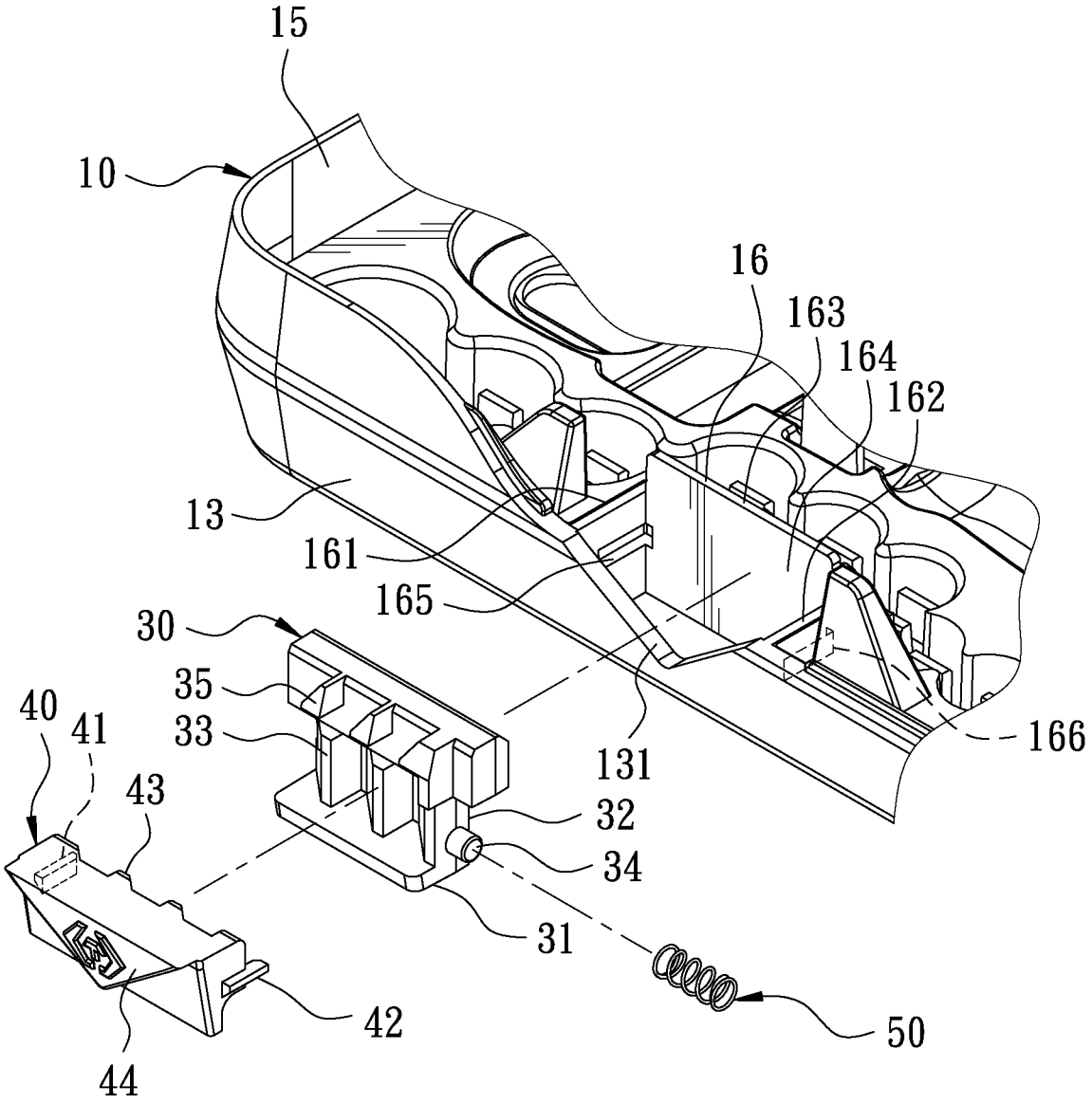
FIG. 3 is a partial exploded view of the preferred embodiment of the present invention.

FIG. 3 is a partial exploded view of the preferred embodiment of the present invention. The inner surface of the first free wall 13 is provided with an accommodating portion 16. The accommodating portion 16 is located in the first space 15. In this embodiment, the accommodating portion 16 has a first stop wall 161 vertically extending from the first free wall 13, a second stop wall 162 vertically extending from the first free wall 13 and spaced apart from the first stop wall 161, and a restricting wall 163 connected between the first stop wall 161 and the second stop wall 162. An accommodating space 164 is defined among the first free wall 13, the first stop wall 161, the second stop wall 162 and the restricting wall 163 for accommodating a locking member 30, a pushing member 40 and an elastic member 50.

Figure 4:
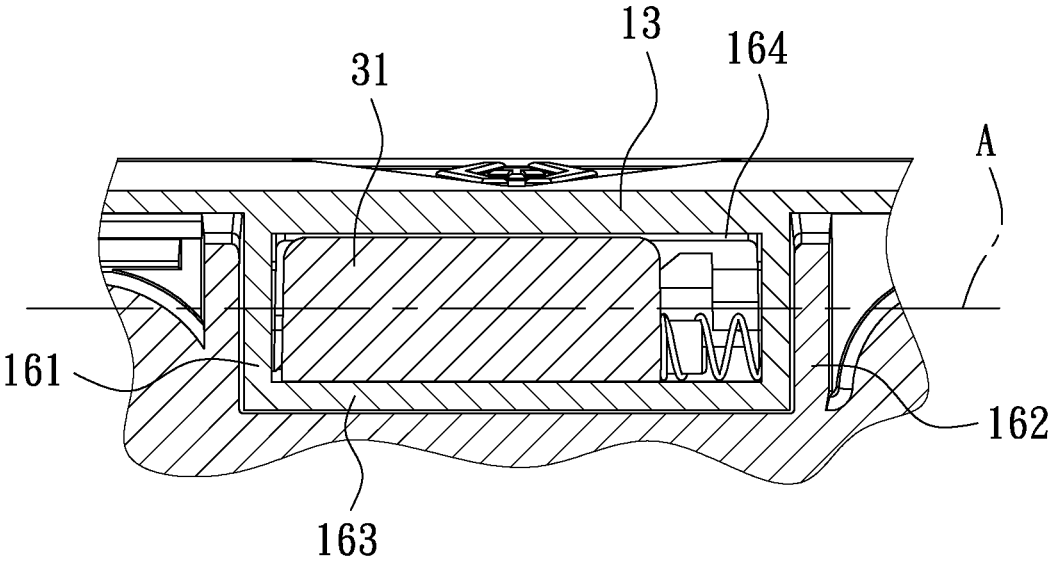
FIG. 4 is a partial cross-sectional view of the preferred embodiment of the present invention.

FIG. 4 is a partial cross-sectional view of the preferred embodiment of the present invention. Referring to FIG. 3, the locking member 30 has a bottom 31. The width of the bottom 31 is substantially equal to a distance between the first free wall 13 and the restricting wall 163, and the length of the bottom 31 is less than a distance between the first stop wall 161 and the second stop wall 162, so that the locking member 30 is movable along a transverse axis A between the first stop wall 161 and the second stop wall 162. The transverse axis A is parallel to the first free wall 13.

Figure 5:
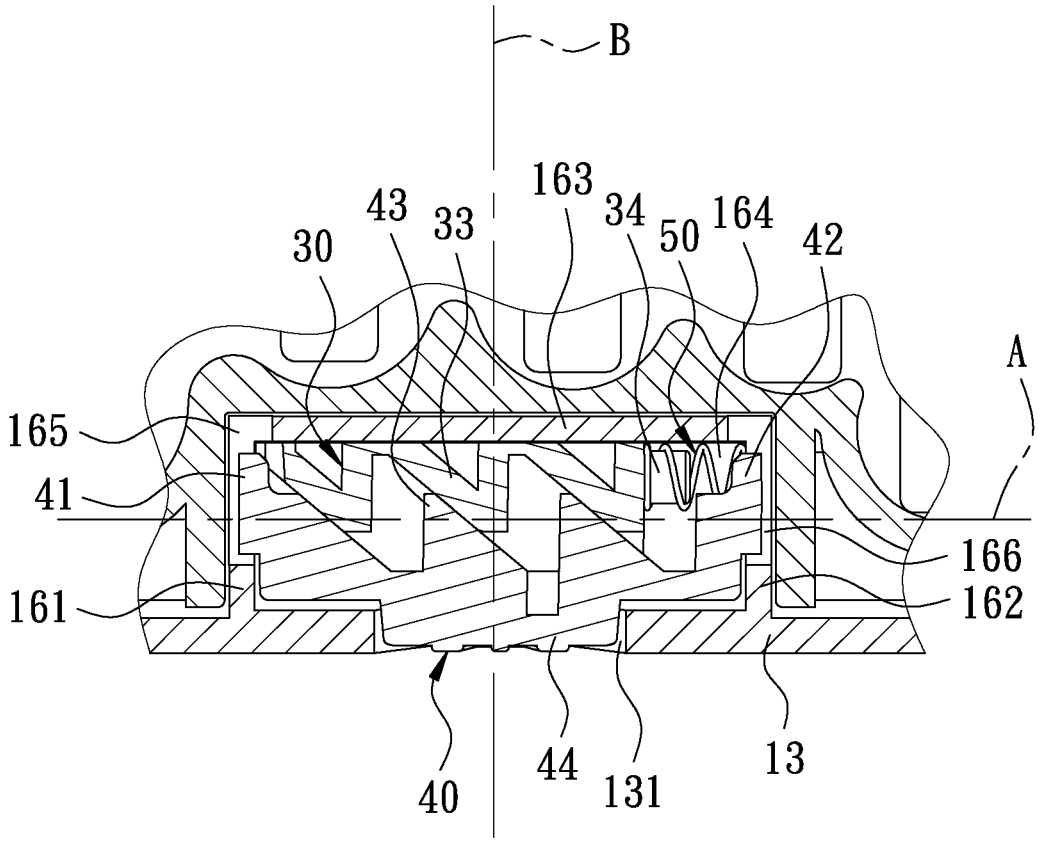
FIG. 5 is a cross-sectional view of the preferred embodiment of the present invention, wherein the pushing member is in an initial position.

FIG. 5 is a cross-sectional view of the preferred embodiment of the present invention, wherein the pushing member is in an initial position. Referring to FIG. 3, the first stop wall 161 has a first slide groove 165 parallel to a longitudinal axis B, and the second stop wall 162 has a second slide groove 166 parallel to the longitudinal axis B. The pushing member 40 is located between the first free wall 13 and the locking member 30. One side of the pushing member 40 has a first slide block 41 corresponding to the first slide groove 165. The first slide block 41 is configured to slide in the first slide groove 165. The other side of the pushing member 40 has a second slide block 42 corresponding to the second slide groove 166. The second slide block 42 is configured to slide in the second slide groove 166. Thus, the pushing member 40 is movable along the longitudinal axis B between the first free wall 13 and the locking member 30. The longitudinal axis B is perpendicular to the first free wall 13.

Please refer to FIG. 3 and FIG. 5. The locking member 30 further has a vertical wall 32 extending upwardly from the bottom 31 of the locking member 30. One side of the vertical wall 32, corresponding to the first free wall 13, has at least one pushed slope 33. The pushed slope 33 gradually slant upward along the transverse axis A. In this embodiment, the vertical wall 32 has a plurality of pushed slopes 33. The pushed slopes 33 slant up along the transverse axis A in a direction from the first stop wall 161 to the second stop wall 162. The pushing member 40 has at least one pushing portion 43 corresponding to the pushed slope 33. The pushing portion 43 is in contact against the pushed slope 33. In this embodiment, the pushing member 40 has a plurality of pushing portions 43. The pushing portion 43 is a pushing slope. The pushing slope slant upward along the transverse axis A in a direction from the second stop wall 162 to the first stop wall 161. The pushing slope is arranged reversely relative to the pushed slope, so that the pushing slope is in planar against the corresponding pushed slope 33.

Figure 6:
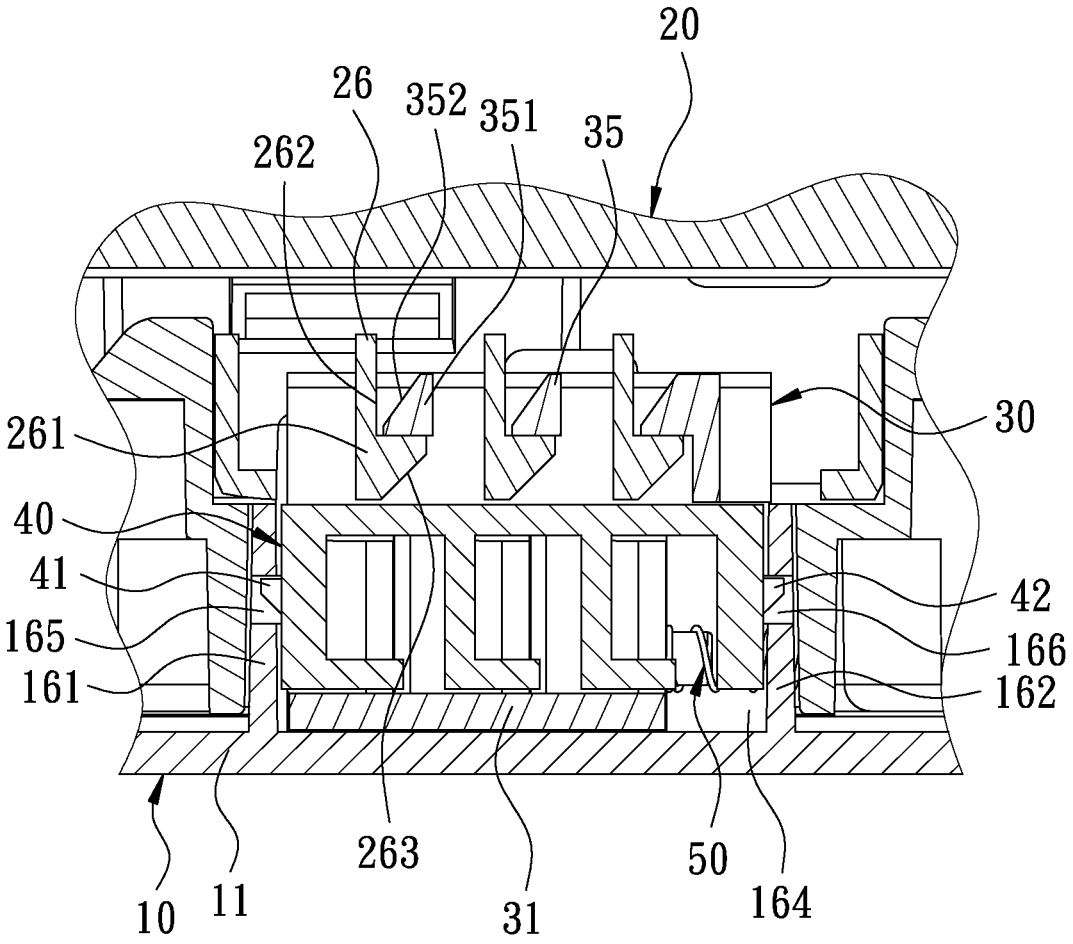
FIG. 6 is a cross-sectional view of the preferred embodiment of the present invention, wherein the locking member is in a closed position.

FIG. 6 is a cross-sectional view of the preferred embodiment of the present invention, wherein the locking member is in a closed position. Referring to FIG. 2, the second free wall 23 is provided with a first locking portion 26 corresponding to the accommodating portion 16. The locking member 30 has a second locking portion 35 corresponding to the first locking portion 26. In this embodiment, the first locking portion 26 has a plurality of protrusions 261. The protrusions 261 are spaced apart from each other and are arranged on the inner surface of the second free wall 23 along the transverse axis A. One side of each of the protrusions 261 is recessed with a locking groove 262. The second locking portion 35 has a plurality of locking blocks 351 corresponding to the locking grooves 262 of the protrusions 261.

Figure 7:
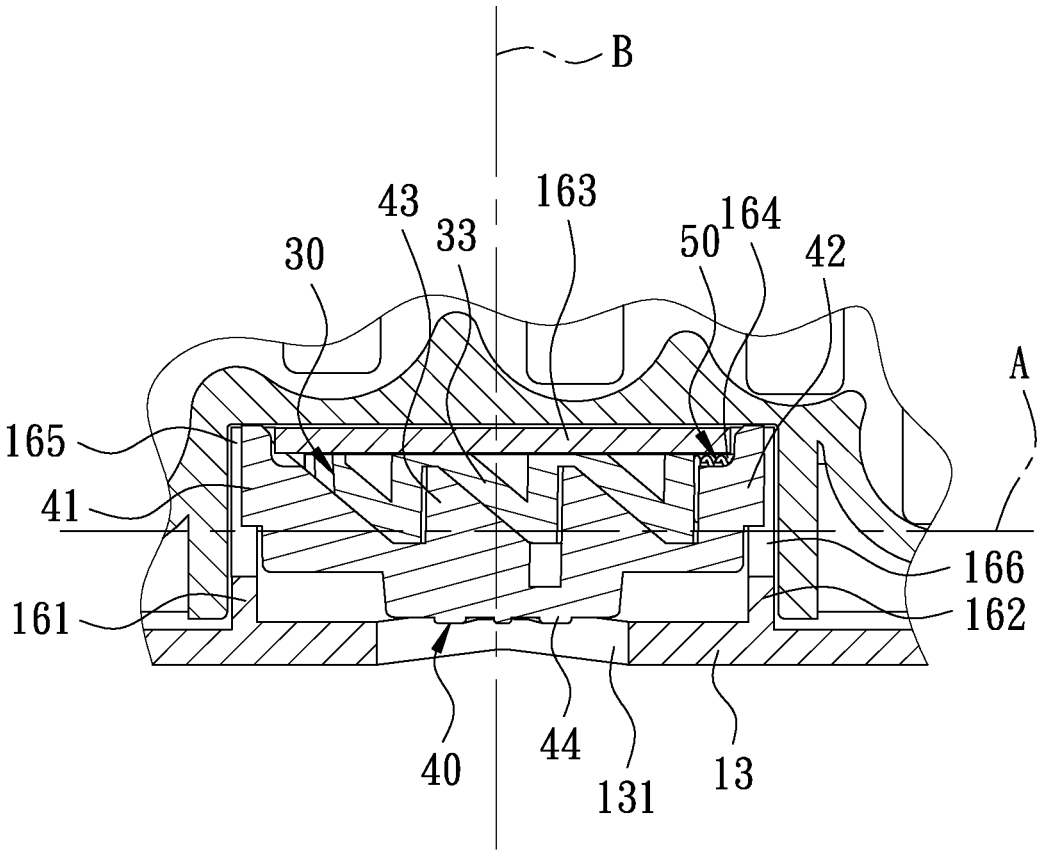
FIG. 7 is a cross-sectional view of the preferred embodiment of the present invention, wherein the pushing member is in a pressed position.
Figure 8:
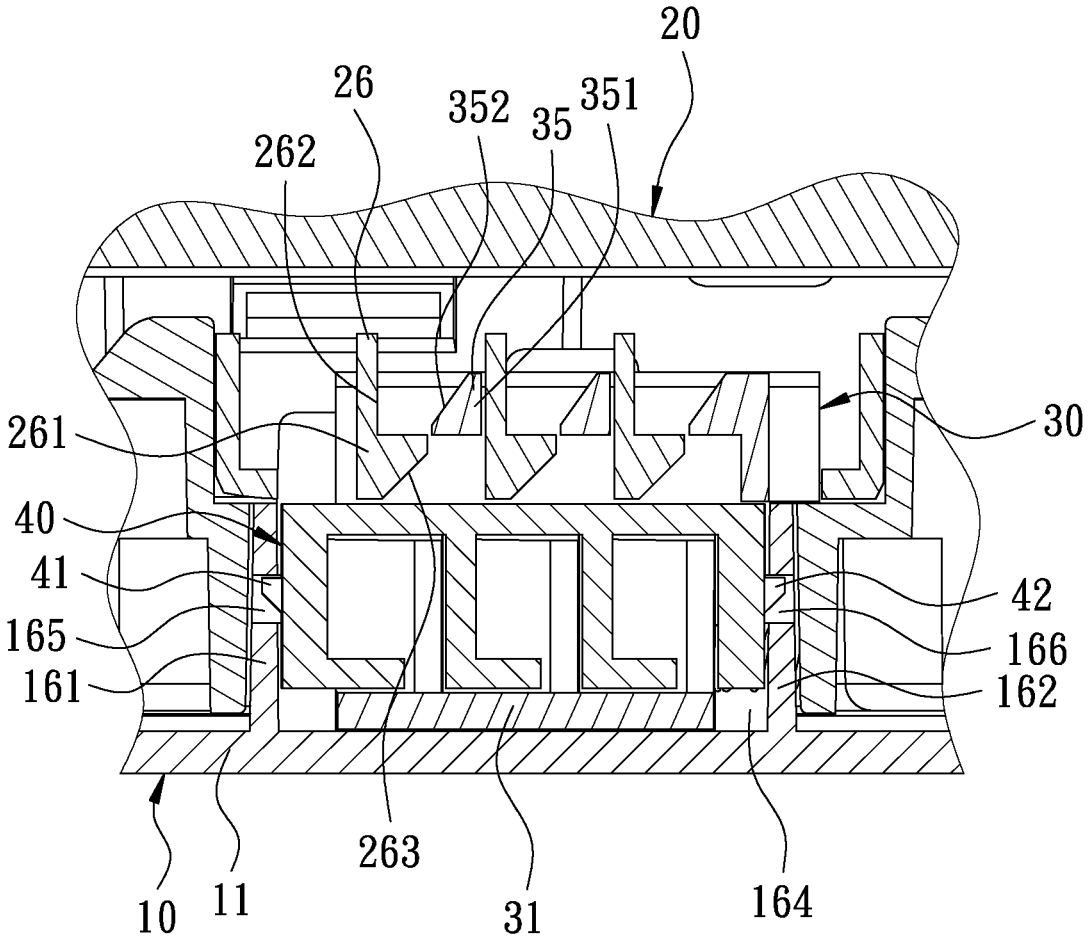
FIG. 8 is a cross-sectional view of the preferred embodiment of the present invention, wherein the locking member is in an open position.

FIG. 7 is a cross-sectional view of the preferred embodiment of the present invention, wherein the pushing member is in a pressed position. FIG. 8 is a cross-sectional view of the preferred embodiment of the present invention, wherein the locking member is in an open position. Please refer to FIG. 5 and FIG. 6. The pushing member 40 is movable relative to the first housing 10 along the longitudinal axis B to be in an initial position as shown in FIG. 5 or in a pressed position as shown in FIG. 7. The locking member 30 is movable relative to the first housing 10 along the transverse axis A to be in a closed position as shown in FIG. 6 or in an open position as shown in FIG. 8. When the locking member 30 is in the closed position, the second locking portion 35 is engaged with the first locking portion 26. When the locking member 30 is in the open position, the second locking portion 35 is disengaged from the first locking portion 26. When the user applies an external force along the longitudinal axis B to press the pushing member 40, the pushing member 40 is moved from the initial position to the pressed position for the pushing portion 43 to push the pushed slope 33, such that the locking member 30 slides along the transverse axis A via the wedged action and moves from the closed position to the open position. The second locking portion 35 is disengaged from the first locking portion 26, so that the second housing 20 can be turned relative to the first housing 10 to open the inner buckling type tool box 100. In this way, through a change in the moving direction, the locking member 30 enables to slide in the inner buckling type tool box 100 in a direction parallel to the first free wall 13, so that the occupation of deep space can be reduced greatly, so as to maintain the capacity of the inner buckling type tool box 100. In addition, because the locking member 30 slides in a direction parallel to the first free wall 13, the first locking portion 26 may have a plurality of spaced locking grooves 262 along the transverse axis A, and the second locking portion 35 may include a plurality of corresponding locking blocks 351, so as to form a plurality of locking structures to improve the locking strength.

It is worth mentioning that, as shown in FIG. 3, a positioning block 34 is provided at one side of the vertical wall 32, corresponding to the second stop wall 162. The elastic member 50 is arranged between the positioning block 34 and the second stop wall 162, and is located along the movement path of the locking member 30 moving from the closed position to the open position. When the locking member 30 is in the open position, the locking member 30 presses the elastic member 50 to store an elastic force. Thus, the elastic member 50 enables to move the locking member 30 with the elastic force. The locking member 30 has a movement tendency to move from the open position to the closed position. Through the lateral component force generated between the pushed slope 33 and the pushing slope, the pushing member 40 has a movement tendency moving from the pressed position to the initial position. In this way, as long as the user applies the external force to press the pushing member 40, the locking member 30 is driven to slide so that the second locking portion 35 is disengaged from the first locking portion 26. When the external force exerted by the user disappears, the elastic member 50 pushes the locking member 30 back to the closed position and moves the pushing member 40 back to the initial position. The second locking portion 35 is locked to the first locking portion 26 again. The user only needs to press the pushing member 40 to open the inner buckling type tool box 100 and release the pushing member 40 to close the inner buckling type tool box 100. It is very intuitive and convenient in operation.

In addition, the first free wall 13 has a notch 131 corresponding to the accommodating groove 164. The pushing member 40 has a pressing portion 44 corresponding to the notch 131. The pressing portion 44 is located in the notch 131, which facilitates the user to press the pushing member 40 through the pressing portion 44. As shown in FIG. 6, the peripheral side of the protrusion 261 has a first slope 263, and the locking block 351 has a corresponding second slope 352. When the locking member 30 is moved from the open position to the closed position, the locking blocks 351 are guided to be locked in the locking grooves 262 via the wedge action between the first slope 263 and the second slope 352.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An inner buckling type tool box, comprising:

a first housing, having a first bottom wall, a peripheral side of the first bottom wall being provided with a first connecting wall and a first free wall, a first space being defined between the first connecting wall and the first free wall, an inner surface of the first free wall being provided with an accommodating portion, the accommodating portion being located in the first space;

a second housing, turnable to cover the first housing, having a second bottom wall, a peripheral side of the second bottom wall being provided with a second connecting wall corresponding to the first connecting wall and a second free wall corresponding to the first free wall, the second connecting wall being connected to the first connecting wall, the second free wall being provided with a first locking portion corresponding to the accommodating portion;

a locking member, disposed on the accommodating portion, being movable relative to the first housing along a transverse axis to be in a closed position or in an open position, the transverse axis being parallel to the first free wall, the locking member having a second locking portion corresponding to the first locking portion, wherein when the locking member is in the closed position, the second locking portion is engaged with the first locking portion; when the locking member is in the open position, the second locking portion is disengaged from the first locking portion;

a pushing member, disposed at the accommodating portion and located between the first free wall and the locking member, being movable relative to the first housing along a longitudinal axis to be in an initial position or in a pressed position, the longitudinal axis being perpendicular to the first free wall, wherein when the pushing member is pressed by an external force to move from the initial position to the pressed position, the pushing member drives the locking member to move from the closed position to the open position;

an elastic member, disposed at the accommodating portion, being configured to provide an elastic force to drive the locking member and make the locking member having a movement tendency to move from the open position to the closed position therefore making the pushing member driven by the locking member to have a movement tendency to move from the pressed position to the initial position.

2. The inner buckling type tool box as claimed in claim 1, wherein the locking member, corresponding to one side of the first free wall, has at least one pushed slope, the pushed slope gradually slant upward along the transverse axis, the pushing member has at least one pushing portion corresponding to the pushed slope, the pushing portion is in contact against the pushed slope, when the pushing member is moved from the initial position to the pressed position, the pushing portion pushes the pushed slope to move the locking member from the closed position to the open position.

3. The inner buckling type tool box as claimed in claim 2, wherein the pushing portion is a pushing slope that is arranged reversely relative to the pushed slope so that the pushing slope is in planar contact with the pushed slope.

4. The inner buckling type tool box as claimed in claim 3, wherein the elastic member is located along a movement path of the locking member moving from the closed position to the open position, when the locking member is moved to the open position, the locking member presses the elastic member, the elastic member pushes the locking member back to the closed position once the external force disappears, and the pushing member has the movement tendency moving from the pressed position to the initial position through a lateral component force generated between the pushed slope and the pushing slope.

5. The inner buckling type tool box as claimed in claim 1, wherein the accommodating portion has a first stop wall vertically extending from the first free wall, a second stop wall vertically extending from the first free wall and spaced apart from the first stop wall, and a restricting wall connected between the first stop wall and the second stop wall, and an accommodating space is defined among the first free wall, the first stop wall, the second stop wall and the restricting wall for accommodating the locking member, the pushing member and the elastic member.

6. The inner buckling type tool box as claimed in claim 5, wherein the locking member has a bottom, the bottom has a width equal to a distance between the first free wall and the restricting wall and a length less than a distance between the first stop wall and the second stop wall, so that the locking member is movable along the transverse axis between the first stop wall and the second stop wall.

7. The inner buckling type tool box as claimed in claim 5, wherein the first stop wall has a first slide groove parallel to the longitudinal axis, the second stop wall has a second slide groove parallel to the longitudinal axis, one side of the pushing member has a first slide block corresponding to the first slide groove, the first slide block is configured to slide in the first slide groove, another side of the pushing member has a second slide block corresponding to the second slide groove, the second slide block is configured to slide in the second slide groove, and the pushing member is movable along the longitudinal axis between the first free wall and the locking member.

8. The inner buckling type tool box as claimed in claim 1, wherein the first locking portion has a plurality of protrusions, the protrusions are spaced apart from each other and are arranged on an inner surface of the second free wall along the transverse axis, one side of each of the protrusions is recessed with a locking groove, and the second locking portion has a plurality of locking blocks corresponding to the locking grooves of the protrusions.

9. The inner buckling type tool box as claimed in claim 8, wherein a peripheral side of each of the protrusions has a first slope, and each of the locking blocks has a corresponding second slope.

10. The inner buckling type tool box as claimed in claim 1, wherein the first free wall has a notch corresponding to the accommodating groove, the pushing member has a pressing portion corresponding to the notch, and the pressing portion is located in the notch.

* * * * *